US009847603B1

(12) United States Patent
Vo et al.

(10) Patent No.: US 9,847,603 B1
(45) Date of Patent: Dec. 19, 2017

(54) GROUNDING SYSTEM AND METHOD FOR PROVIDING ELECTRICAL CONTACT BETWEEN TWO COMPONENTS

(71) Applicant: PAT TECHNOLOGY SYSTEMS INC., Vaudreuil-Dorion (CA)

(72) Inventors: Chau Thien Vo, Roxboro (CA); Nicholas Parent, Montreal (CA)

(73) Assignee: PAT TECHNOLOGY SYSTEMS INC., Vaudreuil-Dorion, Quebec (CA)

( * ) Notice: Subject to any disclaimer, the term of this patent is extended or adjusted under 35 U.S.C. 154(b) by 0 days.

(21) Appl. No.: 15/496,319

(22) Filed: Apr. 25, 2017

(51) Int. Cl.

| | |
|---|---|
| ***H01R 4/66*** | (2006.01) |
| ***H01R 13/652*** | (2006.01) |
| ***H01R 13/17*** | (2006.01) |
| ***H01R 13/207*** | (2006.01) |
| ***H01R 43/18*** | (2006.01) |

(52) U.S. Cl.
CPC ..... *H01R 13/652* (2013.01); *H01R 13/17* (2013.01); *H01R 13/207* (2013.01); *H01R 43/18* (2013.01)

(58) Field of Classification Search
CPC .... H01R 13/652; H01R 13/17; H01R 13/207; H01R 43/18; H01R 9/096; H01R 12/52
USPC ..... 439/106, 65, 66, 74, 75, 96
See application file for complete search history.

(56) References Cited

U.S. PATENT DOCUMENTS

| | | | | |
|---|---|---|---|---|
| 3,333,225 | A * | 7/1967 | McNutt | H01R 29/00 439/692 |
| 5,281,149 | A * | 1/1994 | Petri | H05K 7/142 174/138 D |
| 9,059,545 | B2 | 6/2015 | Mason et al. | |
| 2014/0378008 | A1 | 12/2014 | Young et al. | |
| 2017/0248892 | A1 * | 8/2017 | Yamamoto | H01R 13/17 |

FOREIGN PATENT DOCUMENTS

JP 01201986 A * 8/1989

* cited by examiner

*Primary Examiner* — Tulsidas C Patel
*Assistant Examiner* — Travis Chambers
(74) *Attorney, Agent, or Firm* — Norton Rose Fulbright Canada

(57) ABSTRACT

A grounding system for electrically connecting a first component to a second component. A connection plate has a hole and is configured to be in electrical contact with the first component. A receptacle plate is in electrical contact with the connection plate, and has a receptacle opening aligned with and larger than the hole. A pin has a first end configured to be electrically connected to the second component and an opposed second end receivable through the receptacle opening and through the hole. An electrical connector is retained in electrical contact with the pin. The electrical connector is movable along the pin and biased toward the second end, receivable in the receptacle opening and configured to be in electrical contact with a circumferential surface of the receptacle opening, and has an outer dimension greater than that of the hole so as to be prevented from passing therethrough.

20 Claims, 9 Drawing Sheets

GROUNDING SYSTEM AND METHOD FOR PROVIDING ELECTRICAL CONTACT BETWEEN TWO COMPONENTS

TECHNICAL FIELD

The application relates generally to grounding systems and, more particularly, to adjustable grounding systems, and method for ensuring electrical contact between two components.

BACKGROUND OF THE ART

Grounding systems are usually used to ensure constant and reliable electrical continuity between two components, for example two metal components, without the use of fixed wires and/or connectors, or hard electrical connections. In some situation it is necessary to maintain some variability and flexibility in the distance between the two components.

Particular grounding systems allowing distance variability between two components have been developed. Some known systems provide, for example, socket connectors to interconnect two electric components.

Commonly used systems above are however typically not adapted to maintain hermetic sealing between the two components, or to allow angular flexibility so that the components are easily and safely assembled and disassembled.

SUMMARY

In one aspect, there is provided a grounding system for electrically connecting a first component to a second component, the grounding system comprising: a connection plate having a hole defined therein, the connection plate configured to be in electrical contact with the first component; a receptacle plate mounted to and in electrical contact with the connection plate, the receptacle plate having a receptacle opening defined therethrough, the receptacle opening aligned with and larger than the hole of the connection plate; and a plunger assembly including: a pin having a first end configured to be electrically connected to the second component and an opposed second end, the second end receivable through the receptacle opening and through the hole of the connection plate; and an electrical connector retained in electrical contact with the pin, the electrical connector receivable in the receptacle opening and configured to be in electrical contact with a circumferential surface of the receptacle opening, the electrical connector being movable along the pin and biased toward the second end, the electrical connector having an outer dimension greater than that of the hole of the connection plate so as to be prevented from passing therethrough.

In another aspect, there is provided a grounded box and lid assembly comprising: a receptacle plate in electrical contact with a first one of the box and the lid, the receptacle plate having a receptacle opening defined therethrough, the receptacle opening aligned with and larger than a hole defined in the first one of the box and the lid; a pin having a first end connected to and in electrical contact with a second one of the box and the lid, the pin having an opposed second end, the second end receivable through the receptacle opening and through the hole; and an electrical connector retained in electrical contact with the pin, the electrical connector being receivable in the receptacle opening and configured to be in electrical contact with a circumferential surface of the receptacle opening, the electrical connector being movable along the pin and biased toward the second end, the electrical connector having an outer dimension greater than that of the hole so as to be prevented from passing therethrough.

In a further aspect, there is provided a method of providing electrical contact between first and second relatively movable components, the method comprising: moving a pin in electrical contact with the first component through a receptacle opening defined in a receptacle plate in electrical contact with the second component as the first and second components are moved relative to each other; moving an electrical connector along the pin while maintaining the electrical connector in the receptacle opening, the electrical connector being in electrical contact with the pin and with the receptacle plate.

DESCRIPTION OF THE DRAWINGS

Reference is now made to the accompanying figures in which.

DETAILED DESCRIPTION

Referring to FIGS. 1*a* to 2*b*, there is provided a grounding system 10 for electrically connecting a first component 11 to a second component 14. The grounding system is used to provide electrical continuity between two surfaces that have to maintain distance variability/flexibility between them, without using any connection (wire, connectors . . . ). Hermetic sealing may also be ensured using the present grounding system 10. The first and second components 11, 14 are distant of a variable distance, and the grounding system 10 is adjustable between an extended configuration wherein the first and the second components 11, 14 are at a predetermined maximal distance D1 from each other (see FIGS. 1*a*-1*b*) and a compressed configuration wherein the first and the second components are at a distance D2 smaller that the maximal distance D1 (see FIGS. 2*a*-2*b*).

The predetermined maximal distance is set as a function of the distance that can be allowed between the first and second components 11, 14. For example, if a compressible gasket (not shown) is provided between the first and second components 11, for hermetic sealing, the predetermined maximal distance may be set so that the compressible gasket is not extended further than its maximal extension.

Figure 1A:
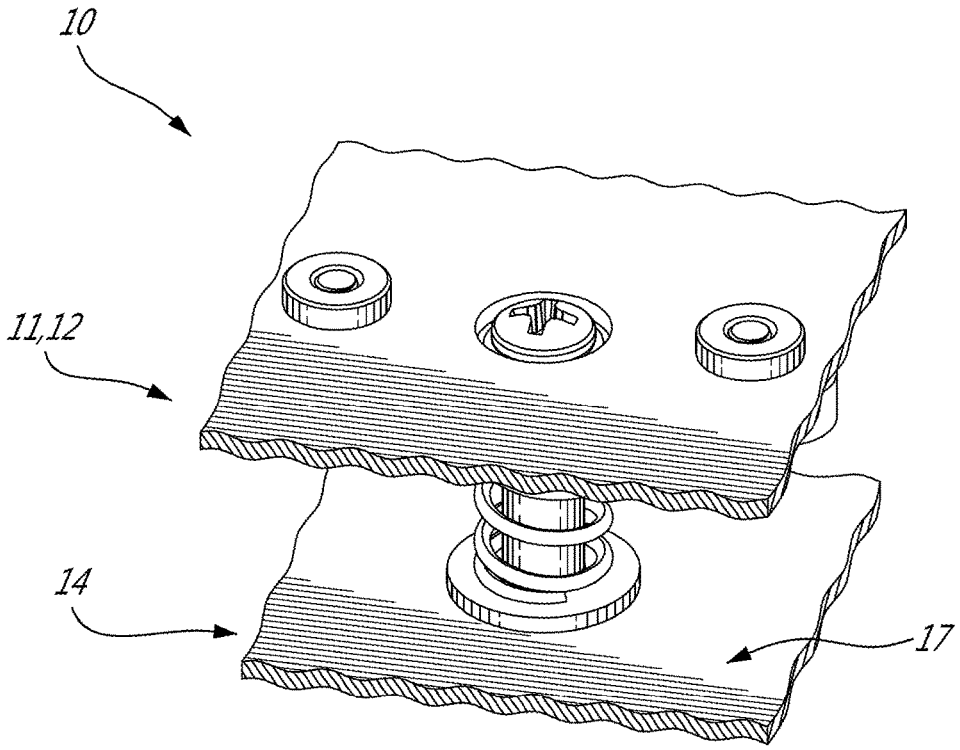
FIG. 1*a* is a schematic tridimensional view of a grounding system in accordance with a particular embodiment, in an extended configuration.
Figure 1B:
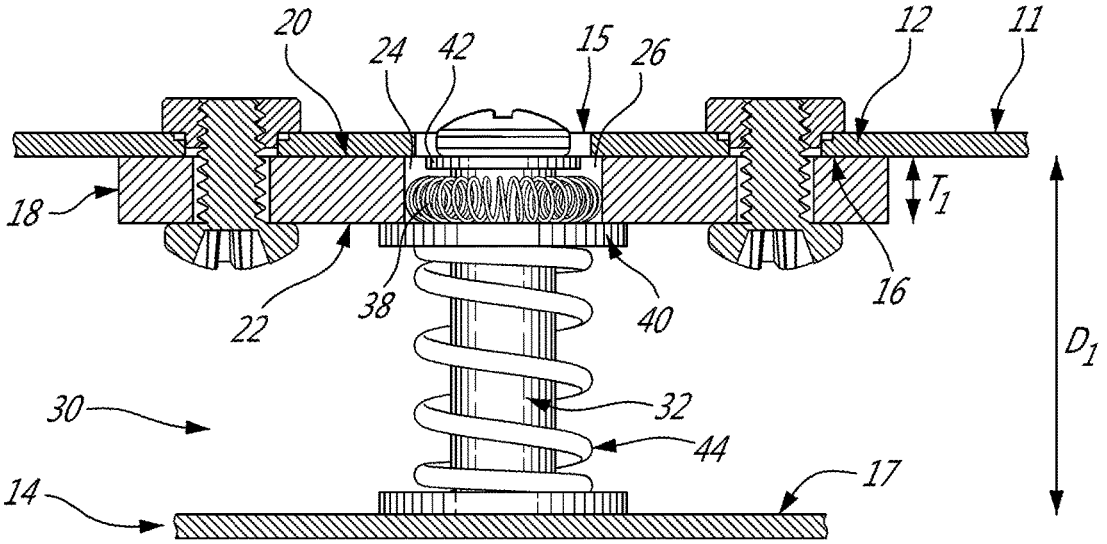
FIG. 1*b* is a schematic cross-sectional view of the grounding system of FIG. 1*a;*
Figure 2A:
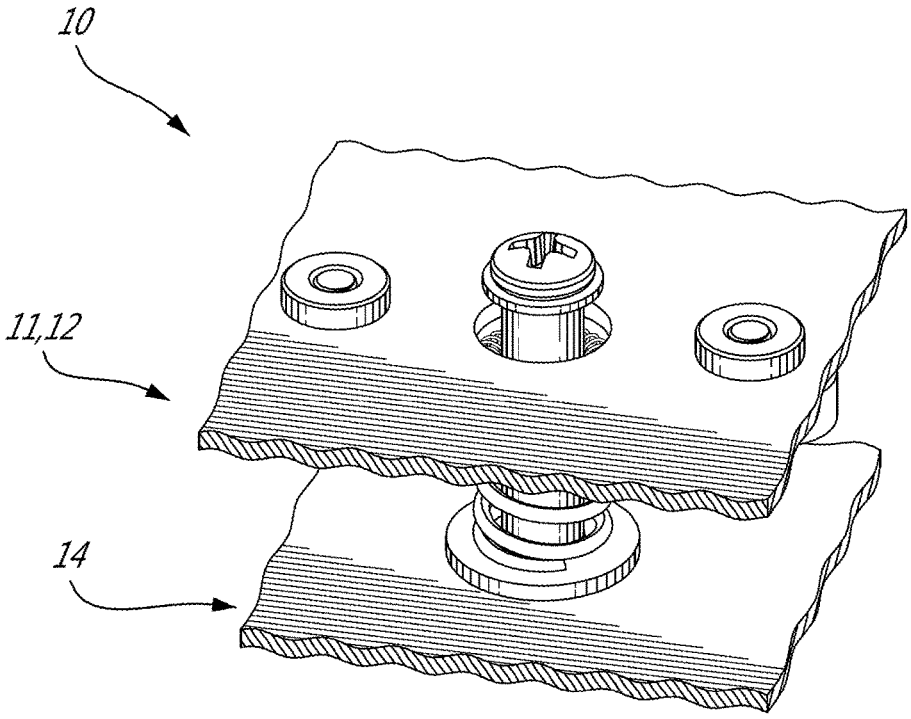
FIG. 2*a* is a schematic tridimensional view of the grounding system of FIGS. 1*a*-1*b*, in a compressed configuration.
Figure 2B:
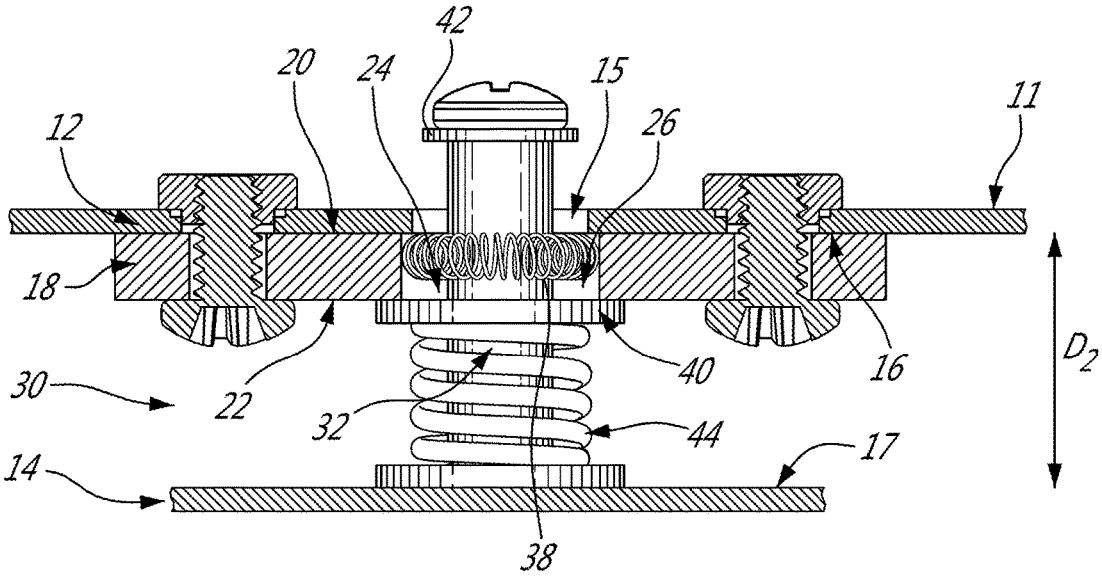
FIG. 2*b* is a schematic cross-sectional view of the grounding system of FIG. 2*a;*

As can be best seen in FIGS. 1*b* and 2*b*, the grounding system 10 includes a connection plate 12 having a hole 15 defined therein. The connection plate 12 is in electrical contact with the first component 11. In a particular embodiment the connection plate 12 is a delimited area of the first component 11, i.e. is an integral part of the first component 11. Alternately, the connection plate 12 may be defined separately and attached to the first component 11 so as to be in electrical contact therewith. The connection plate 12 has a surface 16 facing a surface 17 of the second component 14. The facing surface 17 of the second component 14 may be a delimited area of the second component 14 or may be defined by a separate element (e.g., plate) fastened to and in electrical contact with the second component 14. The surface 16 of the connection plate 12 and the facing surface 17 of the second component 14 are distant from each other of a variable distance, and may further be parallel relative to each other.

It is understood that in the present disclosure, including claims, the term "plate" includes, but is not restricted to, a thin structure having a constant thickness. Various alternate configurations are possible.

Still referring to FIGS. 1*b* and 2*b*, the grounding system 10 includes a receptacle plate 18 that is mounted to and in electrical contact with the connection plate 12. The receptacle plate 18 may be mounted using any suitable type of fastener allowing electrical continuity. In the embodiment shown, metal screws are used to fasten the receptacle plate 18 in electrical contact to the connection plate 12. The receptacle plate 18 includes an inner surface 20 and an outer surface 22 opposite to the inner surface 20. The receptacle plate 18 is mounted to the connection plate 12 so that the inner surface 20 is in electrical contact with the surface 16 of the connection plate 12. The receptacle plate 18 has a thickness T1 defined between the inner surface 20 and the outer surface 22.

The receptacle plate 18 has an opening 24 defined therein. The receptacle opening 24 is defined in both the inner and outer surfaces 20, 22, and through the thickness T1 of the receptacle plate 18. The receptacle opening 24 has a circumferential surface 26, which in the embodiment shown is cylindrical.

The receptacle opening 24 is aligned with the hole 15 of the connection plate 12, so that the receptacle opening 24 and the hole 15 are superposed. The receptacle opening 24 has a diameter larger than the diameter of the hole 15 so that the opening 24 is also aligned with an annular portion of the surface 16 that surrounds the hole 15. In a particular embodiment the opening 24 and the hole 15 are circular. In the embodiment shown, the opening 24 and the hole 15 are concentric.

Still referring to FIGS. 1*b* and 2*b*, the grounding system 10 also includes a plunger assembly 30 that provides the electrical connection between the second component 14 and the receptacle plate 18, and therefore between the second component 14 and the connection plate 12 and first component 11. The plunger assembly 30 is mounted to and in electrical contact with the second component 14 and protrudes towards the receptacle plate 18 and the first component 11.

Figure 3A:
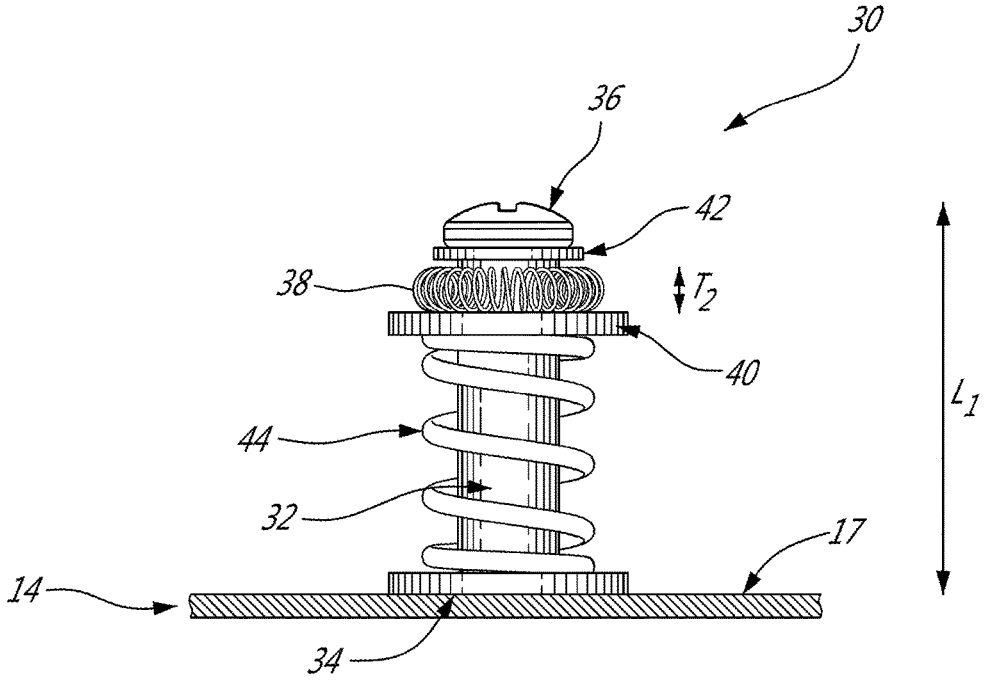
FIG. 3*a* is a schematic side view of a plunger assembly of the grounding system of FIGS. 1*a* to 2*b*, in accordance with a particular embodiment.
Figure 3B:
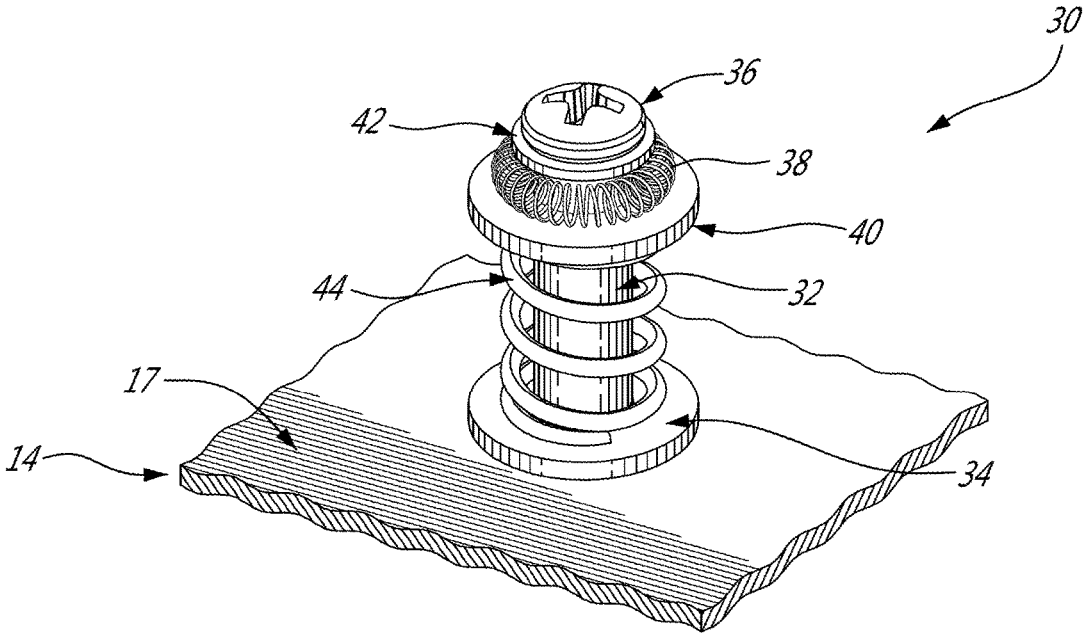
FIG. 3*b* is a schematic tridimensional view of the plunger assembly of FIG. 3*a;*

Referring to FIGS. 3*a*-3*b*, the plunger assembly 30 includes a pin 32 mounted by a first end 34 in electrical contact to the second component 14. In a particular embodiment, the pin 32 is in direct electrical contact with the second component 14. For example, the pin 32 can be mounted to the second component 14 using pressure fit insertion. The pin 32 may also be mounted using an adaptor (such as an additional metal plate) configured to secured the first end 34 of the pin 32 in electrical contact to the second component 14. The pin 32 has a second end 36 opposite the first end 34. The pin 32 extends toward the receptacle plate 18 and has a total length L1 (FIG. 3*a*) defined between the first end 34 and the second end 36. The length L1 of the pin 32 is selected to allow the predetermined maximal distance D1 between the first and the second components 11, 14 and is at least equal to the distance D1. The pin 32 is sized relative to the receptacle opening 24 of the receptacle plate 18 and the hole 15 of the connection plate 12 so that the second end 36 of the pin 32 can extend through both the receptacle opening 24 and the hole 15. In a particular embodiment the pin 32 is a cylindrical pin and the second end 36 is defined by a retaining screw.

The plunger assembly 30 further includes an electrical connector used to provide electrical contact between the receptacle plate 18 and the pin 32; the electrical connector may be any element suitable to transmit electricity between the receptacle plate 18 and the pin 32. In the embodiment shown, the electrical connector is an annular coil 38 made of metal. The coil 38 is received in the receptacle opening 24 and includes a central opening for receiving the pin 32. Therefore, the coil 38 surrounds the pin 32 over a section of a lateral surface of the pin 32. The coil 38 is movable along the length L1 of the pin 32 but prevented from moving passed the second end 36 of the pin 32 for example by a stop member 42 as will be further detailed below. The coil 38 is biased toward the second end 36 of the pin 32, as will be further described below.

Referring to FIGS. 1*b* and 2*b*, it can be seen that the coil 38 has an outer dimension (outer diameter) that is larger than that of the hole 15 in the connection plate 12 so as to be prevented from passing therethrough, and is therefore retained within the receptacle opening 24 when the first and second components get closer to each other; abutment of the coil 38 against the surface 16 of the connection plate 12 prevents the coil 38 from following the pin 32 through the hole 15 of the connection plate 12. The coil 38 has a circumferential outer surface that is in electrical contact with the circumferential surface 26 of the receptacle opening 24. The coil also has a circumferential inner surface in electrical contact with the pin 32. In a particular embodiment, the coil 38 is retained in the receptacle opening 24 in a compressed configuration. In its uncompressed configuration, the outer diameter of the coil 38 is greater than an inner diameter of the receptacle opening 24, so as to be compressed by and against the circumferential inner surface 26 of the receptacle opening 24. In a particular embodiment, this improves the reliability of the contact between the coil 38 and the pin 32, as well as between the coil 38 and the circumferential inner surface 26 of the receptacle opening 24. The coil 38 may also be received in an uncompressed configuration, wherein the outer diameter of the coil 38 is equal to the inner diameter of the receptacle opening 24, and where contact of the coil 38 with both the pin 32 and the circumferential inner surface 26 of the receptacle opening 24 is maintained in the uncompressed configuration.

In the embodiment shown, the coil 38 has a thickness T2 (FIG. 3*a*) that is equal or less than the thickness of the receptacle plate T1 (FIGS. 1*b*, 2*b*). Therefore, the coil 38 is movable (e.g. slidable) along the pin 32 within the receptacle opening 24 while remaining in the receptacle opening 24.

Figure 1C:
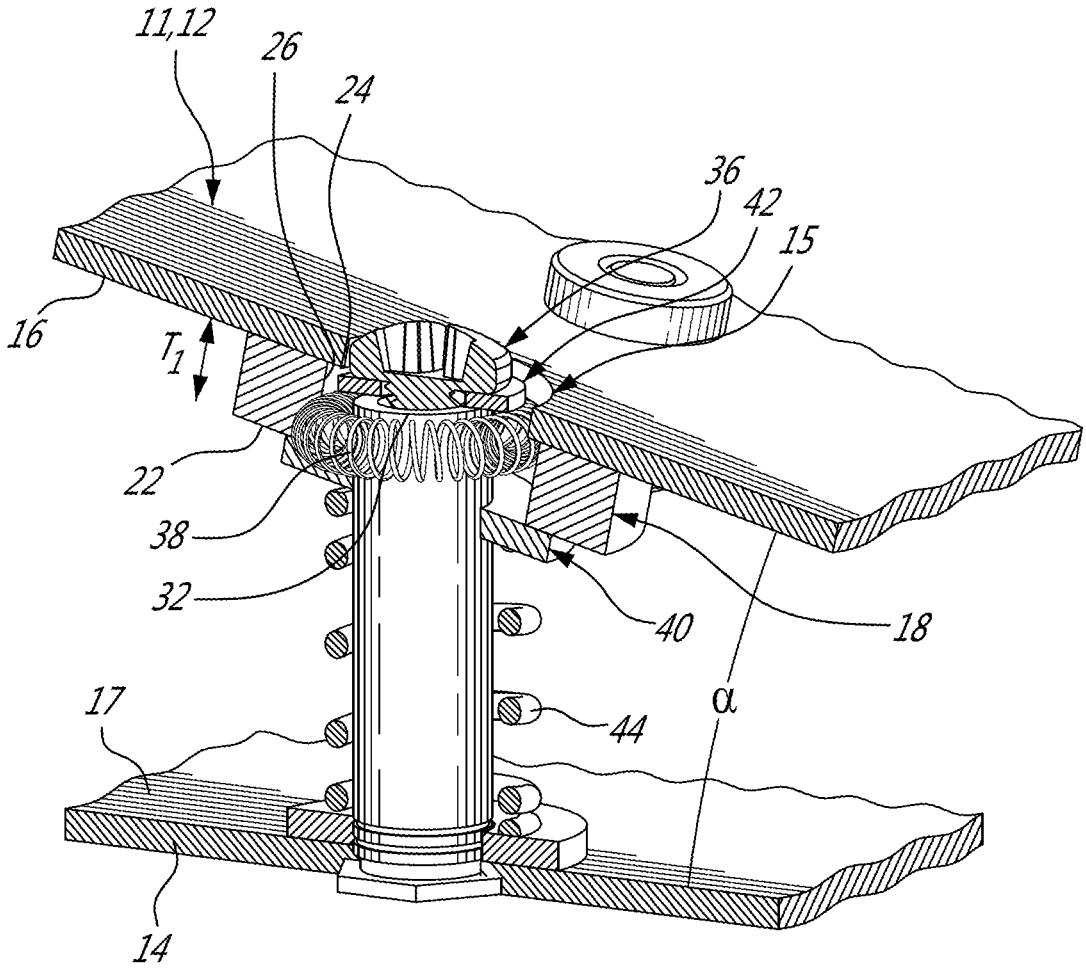
FIG. 1*c* is a schematic, tridimensional cross-sectional view of the grounding system of FIG. 1*a*, in an angled configuration.

In a particular embodiment, the grounding system 10 is configured to allow the plunger assembly 30 to have some leeway in terms of angular movement within the receptacle opening 24. The receptacle plate has a thickness T1 that is low enough to reduce the risk of breaking or bending the plunger assembly 30 if the facing surfaces of the first and second components are moved from being parallel to each other, as illustrated by FIG. 1*c*.

As illustrated in FIGS. 1*b*, 2*b* and 3*b*, in a particular embodiment, the grounding system 10 includes a first stop member 40 preventing the coil 38 from sidling out of the receptacle opening 24 and applying the bias to the coil 38. The first stop member 40 includes a hole defined therein for receiving the pin 32, and is movable along the pin 32. The first stop member 40 is located between the second component 14 and the outer surface 22 of the receptacle plate 18 and has an outer dimension which is greater than the receptacle opening 24, so as to be prevented from passing therethrough and at least partially cover the receptacle opening 24 around the pin 32. The first stop member 40 may have various shapes, as long as it extends across the space defined between the lateral surface of the pin 32 and the circumferential surface 26 of the receptacle opening 24 adjacent the outer surface 22 of the receptacle. For example, in the embodiment shown, the receptacle opening 24 is a circular opening and the pin 32 is a cylindrical pin, and the first stop member 40 is an annular washer having an inner diameter slightly larger than the diameter of the pin 32 and an outer diameter larger than the diameter of the receptacle opening 24. When the first stop member 40 is in contact with the outer surface 22 of the receptacle plate 18, the first stop member 40 retains the coil 38 within the receptacle opening 24.

In a particular embodiment, the coil 38 is prevented from moving out of the second end 36 of the pin 32 by the second stop member 42. The second stop member 42 is connected to the second end 36 of the pin 32, for example electrically connected thereto, and configured to pass through both the hole 15 of the connection plate 12 and the receptacle opening 24 while preventing the coil 38 from moving out of the pin 32. In the embodiment shown, the second stop member 42 is an annular washer secured to the second end 36 of the pin 32 and having an outer diameter larger than an inner diameter of the coil 38 but smaller than the hole 15 in the connection plate 12. The second stop member 42 is secured to the second end 36 of the pin 32, by a retaining screw for example.

In the embodiment shown, the coil 38 is sandwiched between the first stop member 40 and the second stop member 42 when the grounding system 10 is in the extended configuration (see FIG. 1*b*).

In a particular embodiment, as illustrated in FIGS. 1*b*, 2*b* and 3*b*, the grounding system 10 further includes a biasing member 44 located between the first stop member 40 and the second component 14, and biasing the first stop member 40 toward the second end 36 of the pin and the bottom surface 22 of the receptacle plate 18 to bias the coil 38 toward the second end 36 of the pin 32. In the embodiment shown, the biasing member is a spring 44. The spring 44 exerts a force on the first stop member 40 toward the receptacle plate 18, so that the first stop member 40 remains in continuous contact with the bottom surface 22 of the receptacle plate 18 to retain the coil 38 within the receptacle opening 24 when the pin 32 extends through the opening 24. In the embodiment shown, the spring 44 is configured to surround the pin 32. For example, the spring 44 surrounds the pin 32 in a spiral fashion and extends from the second component to the first stop member 40.

Alternately, the biasing member 44 may bias the coil 38 within the receptacle opening 24 directly, i.e. without the need for a stop member therebetween. However, in a particular embodiment, the use of the stop member allows to limit the biasing force applied to the coil 38, which may prevent the coil 38 from being damaged by the biasing force.

Figure 4A:
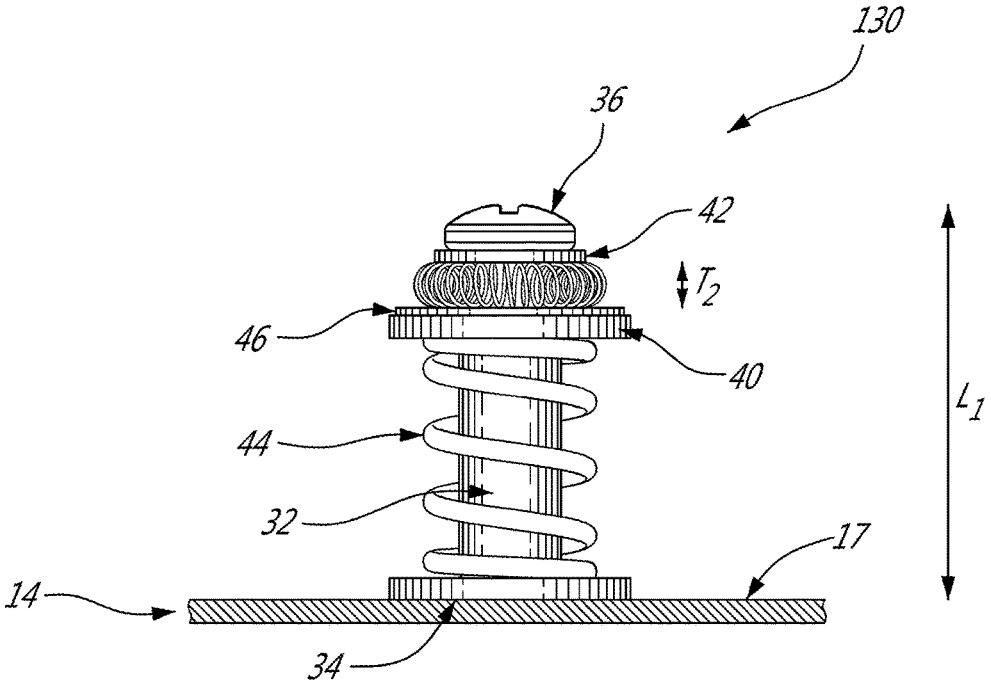
FIG. 4*a* is a schematic side view of a plunger assembly of the grounding system of FIGS. 1*a* to 2*b* in accordance with another particular embodiment, including an annular seal.
Figure 4B:
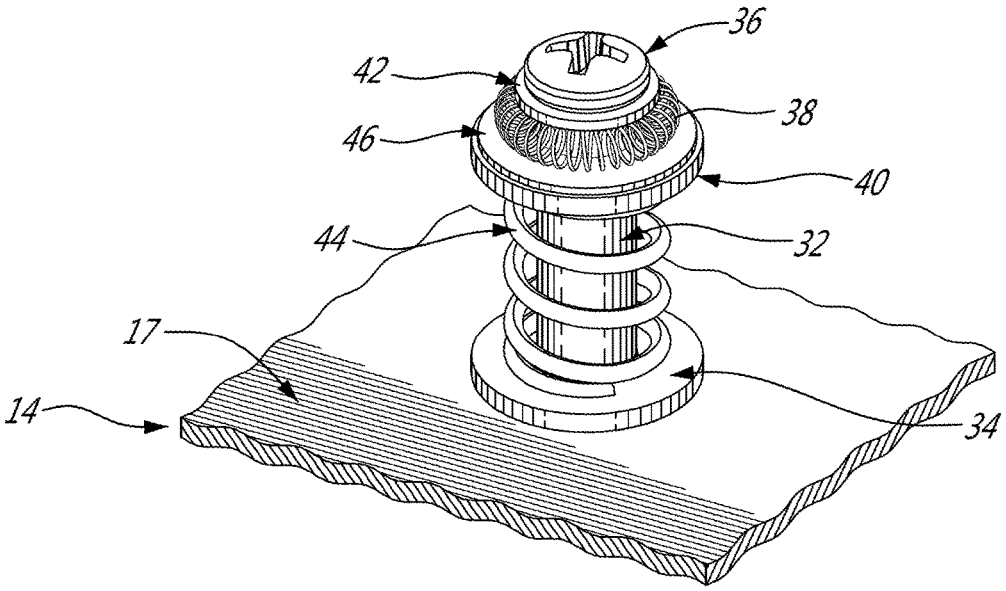
FIG. 4*b* is a schematic tridimensional view of the plunger assembly of FIG. 4*a;*

Referring to FIGS. 4*a*-4*b*, a plunger assembly 130 according to another embodiment is shown, which may be used in the grounding system 10 and is similar to the plunger assembly 30 described above; similar elements are identified by the same reference numerals and will not be described further herein. In this embodiment however, the plunger assembly 130 further includes a seal 46 located between the outer surface 22 of the receptacle plate 18 and the first stop member 40. The seal 46 engages the pin 32 to provide hermetic sealing between the bottom surface 22 of the receptacle plate 18 and the first stop member 40 biased thereagainst. The seal 46 is movable along the pin 32. In the embodiment shown, the seal 46 is an annular seal 46 receiving the pin 32 in a central opening thereof and having an outer diameter larger than the receptacle opening 24.

In a particular embodiment, the seal 46 is an annular rubber washer. The inner diameter of the annular rubber washer is slightly smaller than the diameter of the pin 32 to create a seal between the annular rubber washer and the pin 32 while allowing the annular rubber washer to slide along the length L1 of the pin 32.

Referring back to FIGS. 1*a*-1*b*, in a particular embodiment, when the grounding system 10 is in the extended configuration, the first and second components 11, 14 are at maximal distance D1 from each other while still being in electrical contact with each other through the grounding system 10. The spring 44 pushes the first stop member 40 toward and against the outer surface 22 of the receptacle plate 18 to retain the coil 38 in the receptacle opening 24. Because the diameter of the second stop member 42 is smaller than the hole 15 in the connection plate, the second end 36 of the pin 32 passes through the hole 15 in the connection plate and the receptacle opening 24. The coil 38 is pushed toward the second end 36 of the pin 32 against the second top member 42, which is also received in the receptacle opening 24. The coil 38 is therefore sandwiched between the first and second stop members 40, 42.

When the first and second components 11, 14 are brought closer to each other, the plunger assembly 30 is pushed further into the receptacle opening 24. The coil 38 is retained by the surface 16 of the connection plate 12 and slides along the pin 32 while remaining in the receptacle opening 24. The first stop member 40 is pushed toward the second component 14 by the outer surface 22 of the receptacle plate 18 and the spring 44 is progressively compressed.

In the compressed configuration, illustrated in FIGS. 2*a*-2*b*, the first and second components 11, 14 are at a distance D2 from each other, with D2 being smaller than D1. The first stop member 40 and the spring 44 are held back by the outer surface 22 of the receptacle plate 18, so as to prevent the spring 44 from exerting the biasing force on the coil 38. The coil 38 remains within the receptacle opening 24 due to the first stop member 40, without being crushed or damaged by the spring 44. It can be seen that, if the thickness of the coil T2 is smaller than the thickness of the receptacle opening T1, the coil 38 is not sandwiched between the first and second stop members 40, 42, and a space remains below the coil 38.

In a particular embodiment and referring to FIG. 1*c*, the configuration of the grounding system 10 allows for some angular leeway between the two components 11, 14, particularly when they are at the maximum distance (D1) allowing for an electrical connection to be maintained, i.e. when the assembly is uncompressed. This may allow, for example, for some misalignment upon engaging the two components 11, 14 together, while still allowing electrical contact therebetween through the grounding system 10.

The angular leeway is defined by the interactions of the pin 32 and its second end 36 (e.g. retaining screw), as well of the second stop member 42, with the receptacle opening 24 in the receptacle plate 18, i.e. by the difference between the outer diameters of the pin 32, second end 36 and second stop member 42, and the inner diameter of the surface 26 of the receptacle opening 24. As the pin 32 is tilted with respect to the receptacle plate 18, the maximum leeway will be reached when either the second end 36 of the pin (e.g. retaining screw) and/or the outside diameter of the second stop member 42 make contact with the surface 26 of the receptacle opening 24, or when the pin 32 makes contact with the surface 26 of the receptacle opening 24.

In a particular embodiment, the first stop member 40 is defined by a washer having a sufficiently large inner diameter so as to allow the washer to tilt with respect to the pin 32 and allow for contact between the first stop member 40 and the outer surface 22 of the receptacle plate 18 to be maintained when the pin 32 is tilted with respect to the receptacle plate 18, and in a particular embodiment at the maximum leeway position.

In a particular embodiment, the thickness T1 of the receptacle plate 18 is selected to be at least large enough to allow for the coil 38 to remain within the receptacle opening 24 when the pin 32 and receptacle plate 18 are relatively tilted at the maximum leeway position. In a particular embodiment, the thickness T1 of the receptacle plate 18 is at the minimum value allowing for the coil 38 to remain within the receptacle opening 24 when the pin 32 and receptacle plate 18 are relatively tilted at the maximum leeway position In a particular embodiment, the maximum leeway position defines an angle $\alpha$ of from 14 to 15 degrees between the opposed surfaces 16, 17 of the components. Other values are also possible.

In a particular embodiment, since the plunger assembly 30 protrudes from the second component 14, it may be susceptible to being damaged. For example, the plunger assembly 30 can be snagged or hit by other bodies. In addition, the grounding system 10 may have a small size relative to the first and second components, so that visibility of the grounding system 10 is reduced, and proper alignment of the plunger assembly 30 with the receptacle opening 24 may be difficult to ensure.

Referring to FIGS. 5 and 6*a* to 6*c*, in a particular embodiment, the grounding system 10 further includes an alignment guide 48 is configured to protect the plunger assembly 30 and to help alignment of the plunger assembly 30 with the receptacle opening 24 and the first component hole 15. In the embodiment shown, the alignment guide 48 is provided proximate to the plunger assembly 30 and partially wraps around the plunger assembly 30, as opposed to having the plunger assembly 30 passing through the alignment guide 48. The plunger assembly 30 and receptacle plate 18 are fastened directly to respectively the second component 14 and the first component 11.

The alignment guide 48 includes female element 50 and a male element 52, one on each of the first and second components 11, 14. A first one of the female and male elements 50, 52 is provided on the first component 11, for example on or adjacent the connection plate 12, and the second one of the female and male elements 50, 52 is provided on the surface 17 of the second component 14. In the embodiment shown the male element 52 is provided on the second component 14 proximate the plunger assembly 30, and the female element 50 is provided on the surface 16 of the connection plate 12 proximate the receptacle plate 18.

The female element 50 and the male element 52 are selectively engageable with one another, and accordingly have complementary shapes. In the embodiment shown, the male and female elements 52, 50 have complementary semi-spheroid shapes.

Figure 5:
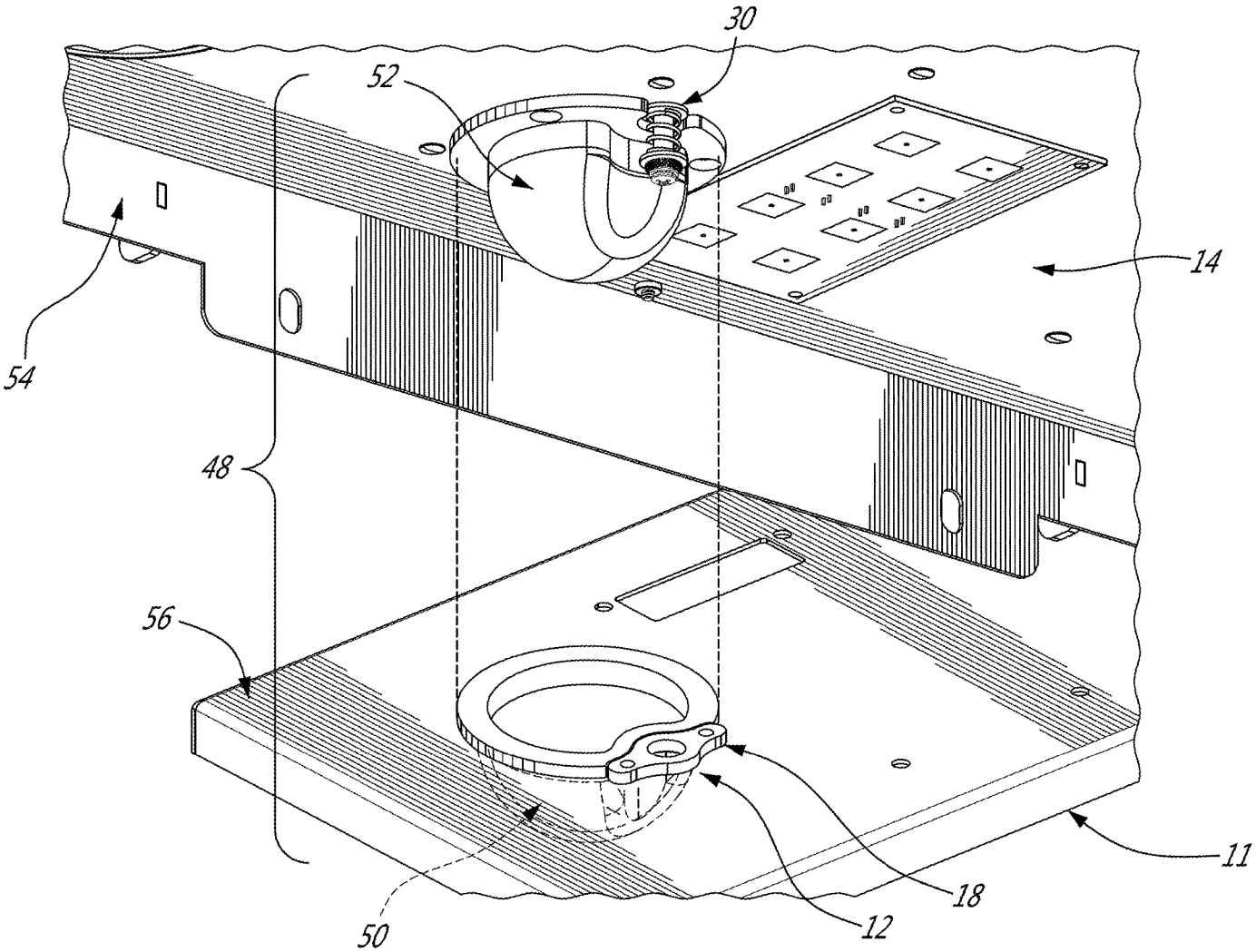
FIG. 5 is a schematic exploded tridimensional view of an alignment guide in accordance with a particular embodiment, which may be used with the grounding system of FIGS. 1*a* to 2*b;*
Figure 6A:
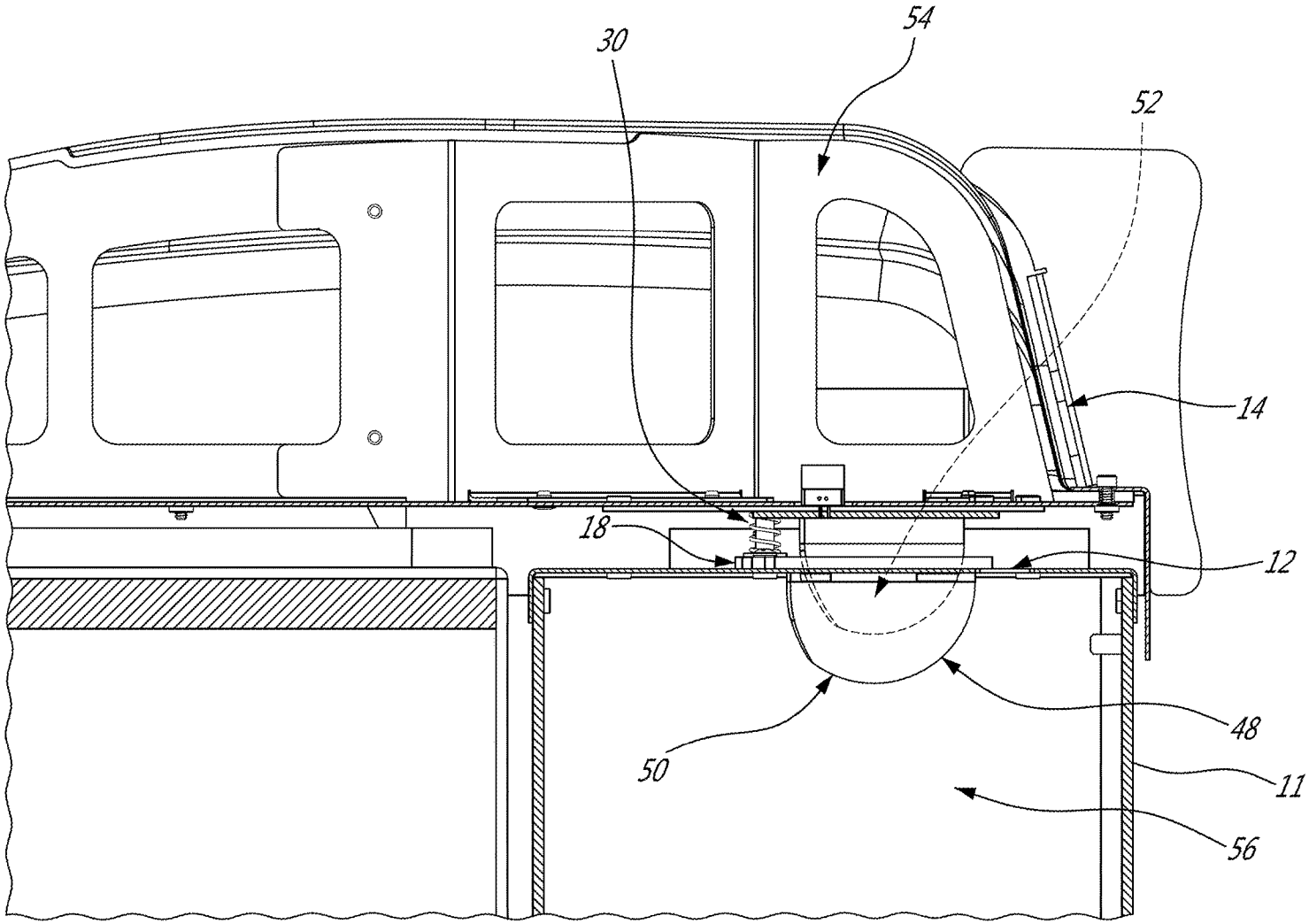
FIG. 6*a* is a schematic cross-sectional view of the alignment guide and grounding system of FIG. 5 installed in a box and lid assembly, with the grounding system in an extended configuration and with the lid parallel to a surface of the box.
Figure 6B:
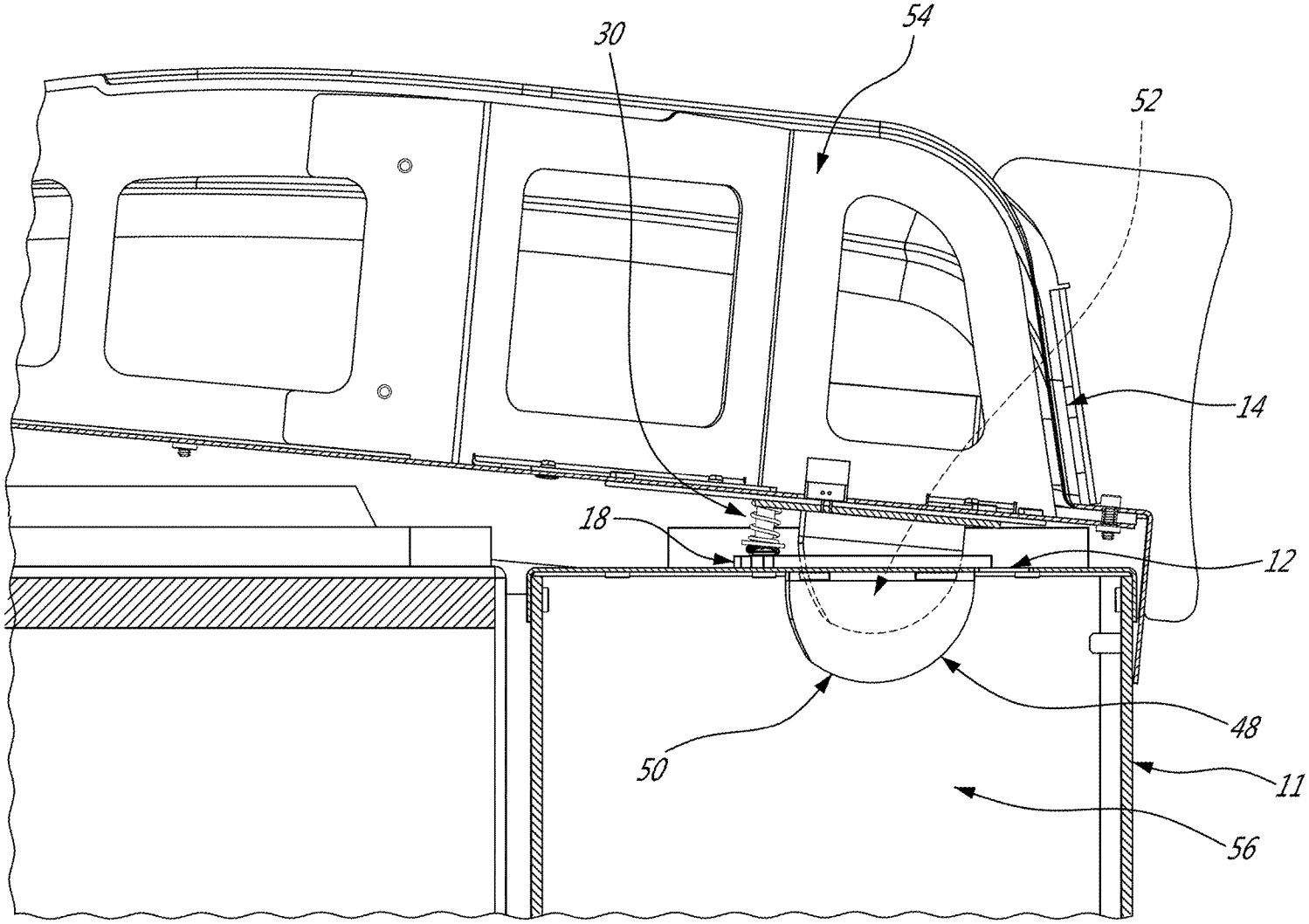
FIG. 6*b* is a schematic cross-sectional view of the assembly of FIG. 6*a*, with the grounding system in the extended configuration and with the lid being titled with respect to the surface of the box.
Figure 6C:
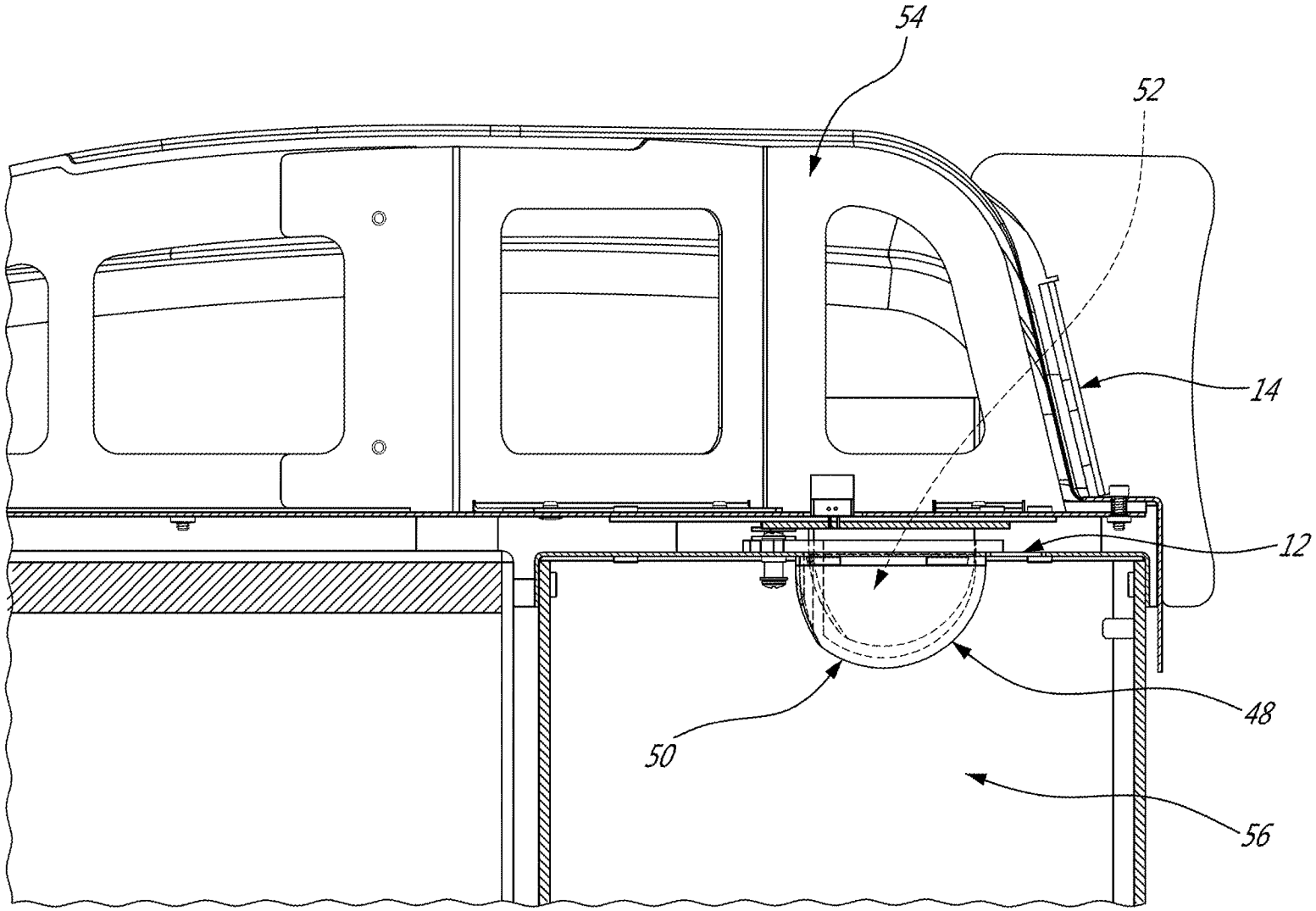
FIG. 6*c* is a schematic cross-sectional view of the assembly of FIG. 6*a*, with the grounding system in a compressed configuration and with the lid parallel to a surface of the box.

In a particular embodiment, as illustrated in FIG. 5, the semi-spheroid shaped male element 52 is mounted to the second component 14 and wraps around the plunger assembly 30 while the female element 50 is mounted to the first component 11 and defines a semi-spheroid recipient (or "cup") for receiving the male element 52 therein. The male element 52 extends from the second component 14 a distance L2 which is larger than the length L1 of the pin 32 and protects the plunger assembly 30 along its entire length L1. The male element 52 provides a lateral obstruction to potential hits from other bodies due to the wrap-around shape. In a particular element, the male element 52 protruding a distance larger than the length of the plunger assembly 30 may allow improved visual detection of misalignment between the plunger assembly 30 and the hole 15 in the first component.

As can be seen in FIG. 5, the male element 52 has a full surface free of holes. In a particular embodiment, the absence of holes allows to avoid air leaks which may compromise the hermetic sealing between the first and second components.

The alignment guide 48 also allows for leeway in term of angular movement and gradual alignment. As the first and second components come closer together, the alignment becomes more precise.

In a particular embodiment, the alignment guide 48 and the male and female element 52, 50 composing the same are made in ABS material. In addition, the male and female 52, 50 elements may be manufactured using 3D printing.

The grounding system 10 may be used in any application where a box or case has to be mated with another box or case or with a lid, for example on a fume extractor to be mated to another plenum box or to a lid. It is understood that further reference to a plenum box and a lid would also apply to two plenum boxes, or any other mating components that have to remain in electrical contact. Compressible foam gaskets may be provided between the lid and the plenum box that compress to varying degrees during operation as the negative pressure in the system changes.

In the particular embodiment shown, the grounding system 10 is used on a modular fume extractor box and lid. The lid of the modular fume extractor is removable by the end-user. However, it cannot be expected that the end-user will remove or install the lid in a perfectly straight up and down path. An angular path or curved path is expected. In addition, electrical continuity is required between the box and the lid each defining a plenum while allowing compression of a gasket therebetween to ensure proper air sealing between the box and the lid. The compression is variable depending on the clamping pressure applied when securing the box and the lid together or depending on the vacuum pressure between the box and the lid which might pull the box and the lid closer together as negative pressure increases.

As can be seen on FIGS. 5 and 6, the plunger assembly 30 and the semi-spheroid male element 52 of the alignment guide 48 are mounted to the bottom of the lid 54. The receptacle plate 18 and the female element 50 of the alignment guide 48 are mounted to the top of the box 56. The connection plate 12 is an integral part of the box 56. It is understood that alternately, the plunger assembly 30 may be mounted to the box 56 and the receptacle plate 18 to the lid 54.

In a particular embodiment, upon initial placement of the lid 54 onto the box 56, the male element 52 protects the plunger assembly 30 even if the lid 54 is placed onto the box 56 with force and with misalignment. If the lid 54 is misaligned with respect to the grounding system 10, it will be visually detectable due to the unparalleled seating of the lid 54 onto the box 56 which is caused by the male element 52 not sitting in the female element 50. Once the male element 52 is aligned with the female element 50, the plunger assembly 30 gradually aligns with the receptacle plate 18 of the grounding system 10. The grounding system 10 also allows the lid 54 to be moved along an angular or curved path without the risk of bending or breaking the plunger assembly 30. The ground circuit is automatically defined and electrical continuity is provided once the lid 54 is installed.

The grounding system 10 maintains electrical continuity between the lid 54 and the box 56 despite the change in the distance between them and also preserves the hermetic seal between the lid 54 and the box 56. The lid 54 can be installed and removed by placing or lifting the lid 54 without having to be gentle or precise or maintaining a perfectly straight up/down path. Indeed, because of the alignment guide 48, the plunger assembly 30 and the receptacle plate 18 of the fume extractor are aligned.

In a particular embodiment and in use, the grounding system 10 thus allows for electrical contact between two relatively movable components to be maintained as the two components are moved relative to each other. The two components are distant of a variable distance, which maximal value is $D_1$. The two components may be, for example, two plenums boxes of a fume extractor that have to be mated with each other, or a plenum box and a lid to be installed on the plenum box.

The receptacle plate 18 is mounted to and in electrical contact with the connection plate 12 configured to be in electrical contact with the first one of the two components. The receptacle plate 18 may be mounted using metal screw or any other type of fastening elements allowing electrical continuity between the receptacle plate and the first component.

The pin 32 is mounted to and in electrical contact with the second one of the two components. The pin 32 has a length a least equal to the predetermined maximal distance $D_1$ to allow the two components to be distant of $D_1$ while ensuring electrical continuity. The pin 32 may be mounted by pressure fit insertion or any other type of fastening method allowing electrical continuity between the pin 32 and the second component. The pin is sized to be received in the receptacle opening 24 and the hole 15 of the connection plate 12.

Electrical contact is provided between the pin and the receptacle plate 18, using a connector, such as the coil 38, in contact with both the pin and the circumferential surface of the receptacle opening 24. The coil 38 is movable along the pin 32 and remains in the receptacle opening 24.

The electrical connection is provided by moving the pin 32 through the receptacle opening 24 and the hole 15 defined in the connection plate 12 as the two components are moved relative to each other. The coil 38 is also moved along the pin 32 while being maintained in the opening 24, in electrical contact with both the pin 32 and the receptacle plate 18.

In a particular embodiment, hermetic sealing is also provided between the pin 32 and the receptacle plate 18. Hermetic sealing may be ensured by covering the space defined between the lateral surface of the pin 32 and the circumferential surface of the receptacle opening 24. For example, the stop member 40 and rubber seal 46, both having a central opening for receiving the pin 32 therein, may be biased against the receptacle plate 18 to retain the coil 38 within the receptacle opening 24 and to ensure hermetic sealing between the pin 32 and the receptacle plate 18.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A grounding system for electrically connecting a first component to a second component, the grounding system comprising:

a connection plate having a hole defined therein, the connection plate configured to be in electrical contact with the first component;

a receptacle plate mounted to and in electrical contact with the connection plate, the receptacle plate having a receptacle opening defined therethrough, the receptacle opening aligned with and larger than the hole of the connection plate; and a plunger assembly including:

a pin having a first end configured to be electrically connected to the second component and an opposed second end, the second end receivable through the receptacle opening and through the hole of the connection plate; and an electrical connector retained in electrical contact with the pin, the electrical connector receivable in the receptacle opening and configured to be in electrical contact with a circumferential surface of the receptacle opening, the electrical connector being movable along the pin and biased toward the second end, the electrical connector having an outer dimension greater than that of the hole of the connection plate so as to be prevented from passing therethrough.

2. The grounding system as defined in claim 1, further comprising a second stop member connected to the second end of the pin and sized to pass through the hole of the connection plate and through the receptacle opening, the second stop member preventing the electrical connector from moving passed the second end of the pin.

3. The grounding system as defined in claim 1, wherein the electrical connector is an annular coil surrounding the pin.

4. The grounding system as defined in claim 3, wherein the annular coil is receivable in the receptacle opening in a compressed configuration, wherein an outer diameter of the annular coil in an uncompressed configuration is greater than a diameter of the circumferential surface of the receptacle opening.

5. The grounding system as defined in claim 1, further comprising a first stop member having a hole defined therein receiving the pin, the first stop member being sized so as to be prevented from passing through the receptacle opening and being located between the first end of the pin and the receptacle plate, the first stop member movable along the pin and biased toward the second end to bias the electrical connector toward the second end.

6. The grounding system as defined in claim 5, wherein the plunger assembly also comprises an annular seal located between the receptacle plate and the first stop member and sealingly engaging the pin, the annular seal being movable along the pin and having an outer diameter larger than that of the receptacle opening.

7. The grounding system as defined in claim 5, further comprising a spring extending between the first end of the pin and the first stop member and biasing the first stop member toward the second end of the pin.

8. The grounding system as defined in claim 1, further comprising an alignment guide including complementary female and male elements selectively engageable with one another adjacent the plunger assembly, wherein a first one of the female and male elements is configured to be connected to the first component and a second one of the female and male elements is configured to be connected to the second component and located in register with the first one of the female and male elements.

9. The grounding system as defined in claim 8, wherein the male element is partially wrapped around the plunger assembly.

10. The grounding system as defined in claim 8, wherein the male element and the female element have a complementary semi-spheroid shape.

11. A grounded box and lid assembly comprising:

a receptacle plate in electrical contact with a first one of the box and the lid, the receptacle plate having a receptacle opening defined therethrough, the receptacle opening aligned with and larger than a hole defined in the first one of the box and the lid;

a pin having a first end connected to and in electrical contact with a second one of the box and the lid, the pin having an opposed second end, the second end receivable through the receptacle opening and through the hole; and an electrical connector retained in electrical contact with the pin, the electrical connector being receivable in the receptacle opening and configured to be in electrical contact with a circumferential surface of the receptacle opening, the electrical connector being movable along the pin and biased toward the second end, the electrical connector having an outer dimension greater than that of the hole so as to be prevented from passing therethrough.

12. The assembly as defined in claim 11, further comprising a first stop member having a hole defined therein receiving the pin, the first stop member being sized so as to be prevented from passing through the receptacle opening and being located between the first end of the pin and the receptacle plate, the first stop member movable along the pin and biased toward the second end to bias the electrical connector toward the second end.

13. The assembly as defined in claim 12, further comprising an annular seal located between the receptacle plate and the first stop member and sealingly engaging the pin, the annular seal being movable along the pin and having an outer diameter larger than that of the receptacle opening.

14. The assembly as defined in claim 12, further comprising a spring extending between the first end of the pin and the first stop member and biasing the first stop member toward the second end of the pin.

15. The assembly as defined in claim 11, wherein the electrical connector is an annular coil surrounding the pin.

16. The assembly as defined in claim 15, wherein the annular coil is retained in the receptacle opening in a compressed configuration, wherein an outer diameter of the annular coil in an uncompressed configuration is greater than a diameter of the circumferential surface of the receptacle opening.

17. The assembly as defined in claim 11, further comprising an alignment guide including complementary female and male elements selectively engageable with one another adjacent the pin, wherein a first one of the female and male elements is connected to the first one of the box and the lid and a second one of the female and male elements is connected to the second one of the box and the lid and located in register with the first one of the female and male elements.

18. The assembly as defined in claim 17, wherein the male element is partially wrapped around the pin.

19. A method of providing electrical contact between first and second relatively movable components, the method comprising:

moving a pin in electrical contact with the first component through a receptacle opening defined in a receptacle plate in electrical contact with the second component as the first and second components are moved relative to each other;

moving an electrical connector along the pin while maintaining the electrical connector in the receptacle opening, the electrical connector being in electrical contact with the pin and with the receptacle plate.

20. The method of claim 19, further comprising engaging complementary male and female alignment guides respectively connected to the first and second components adjacent the pin and the receptacle plate while moving the first and second components relative to each other.

* * * * *